United States Patent [19]

Yuasa et al.

[11] Patent Number: 4,689,285

[45] Date of Patent: Aug. 25, 1987

[54] METHOD FOR DEVELOPING ELECTROSTATIC IMAGE USING MAGNETIC BRUSH AND ONE COMPONENT MAGNETIC TONER

[75] Inventors: Yasuhito Yuasa, Neyagawa; Kazumasa Hayashi, Osaka; Koreaki Nakata, Takarazuka; Akihiro Okuma, Ikoma, all of Japan

[73] Assignee: Matsushita Electric Industrial Co., Ltd., Osaka, Japan

[21] Appl. No.: 772,750

[22] Filed: Sep. 4, 1985

[51] Int. Cl.[4] ..... G03G 13/09

[52] U.S. Cl. ..... 430/122; 430/106.6; 118/658

[58] Field of Search ..... 430/122; 118/658

[56] References Cited

U.S. PATENT DOCUMENTS

| | | | |
|---|---|---|---|
| 4,121,931 | 10/1978 | Nelson | 96/1 |
| 4,259,427 | 3/1981 | Ohmuro et al. | 430/107 |
| 4,486,089 | 12/1984 | Itaya | 430/122 |

FOREIGN PATENT DOCUMENTS

| | | |
|---|---|---|
| 2361418 | 6/1974 | Fed. Rep. of Germany . |
| 1396979 | 12/1972 | United Kingdom . |

*Primary Examiner*—J. David Welsh

*Attorney, Agent, or Firm*—Wenderoth, Lind & Ponack

[57] ABSTRACT

An electrophotographic developing method for developing an electrostatic image formed on an electrostatic image supporting member by using a mono-component insulative developer is disclosed. Electrical potential of said developer for developing the electrostatic image is produced by frictional charging effect of said developer.

5 Claims, 13 Drawing Figures

METHOD FOR DEVELOPING ELECTROSTATIC IMAGE USING MAGNETIC BRUSH AND ONE COMPONENT MAGNETIC TONER

BACKGROUND OF THE INVENTION

1. Field of the Invention

This invention relates to a method for developing an electrostatic image on an electrostatic image supporting member using a mono-component developer consisting of insulative magnetic toner.

2. Description of the Prior Art

In copiers which employ an electrophotographic process, a magnetic brush developing method using a two-component developer is commonly used as a method for developing an electrostatic image.

According to this method, while a sleeve having a magnet contained therein is being rotated, an electrostatic image supporting member is brushed with a brush-formed toner layer which is formed by attracting and holding magnetic developer on the sleeve to develop an electrostatic image. While this method provides a good developed image, it has drawbacks that fatigue of a carrier occurs and that the mixture ratio between the carrier and toner varies.

Meanwhile, in a method which employs a mono-component developer, the developer contains toner as a main component and contains no carrier particles. Therefore, such drawbacks as described above can be avoided. In order to attain such an advantage of the mono-component developer, several techniques have been already developed.

U.S. Pat. No. 4,121,931 discloses a mono-component developing method employing insulative magnetic toner. The insulative toner has a specific resistance of higher than $10^{12}$ Ωcm. An electric field which acts upon toner particles within a developing zone increases due to the presence of an electrical potential caused by a voltage source existing between a developer supporting member (hereinafter referred to as a sleeve) and an electrostatic image supporting member (hereinafter referred to as a drum) and other members and also to the presence of an electrical potential on the drum, so that, when the toner particles repetitively and turbulently contact a conductive portion of the developer supporting member, electric charges are injected onto the toner particles from the conductive face of the sleeve to charge the toner particles. In this instance, the amount of charges caused by friction is too little to contribute to the charging of the toner particles as a whole. According to this method, since the amount of charges caused by friction is very little, a strong electric field is required between the drum and the sleeve in order to provide toner particles with charges necessary for developing when a high density picture image is to be obtained. When the electric field is caused by a low electrostatic latent image potential, developing is difficult. Also, application of a high electric field will increase power consumption, and reduce the life of the drum.

In U.S. Pat. No. 4,259,427, magnetic toner has a specific resistance of $10^{14}$ Ωcm or more for insulation, and magnetic particles are arranged on a surface of each magnetic toner particle, so that the toner particles are charged by their mutual friction when they are transported. In this instance, the magnetite on a particle surface and the resin are mutually rubbed, so that the magnetite is charged negative while the resin is charged positive. As a result, each toner particle will have a number of positive and negative charges on a surface thereof. Some toner particles are charged positive while the other particles are charged negative. The positively charged particles and negatively charged particles present in a toner layer are cancelled by each other. When toner particles are charged by mutual friction thereamong, since there exist positively charged toner particles and negatively charged particles, toner particles will adhere to a countercharged portion of the drum of reverse polarity around an electrostatic image, causing useless toner consumption. Toner particles which adhere to the drum upon development may be used with an efficiency of 50 to 55 percent for a picture image on paper, and the remainder will remain unused and be scraped off the drum in a cleaning step. Further, since the magnetite protrudes from a surface of the resin in the toner, a photoconductor of Se or the like is readily damaged at a surface thereof, and hence such toner will naturally provide a limitation to a photoconductor to be used therewith. Further, if the picture image density is adjusted with a DC bias, toner will adhere to a non-image area. Accordingly, adjustment with a DC bias is not appropriate.

In German Patent Application Laid-Open Specification No. 2,361,418, magnetic toner has a specific resistance of $10^{10}$ to $10^{16}$ Ωcm, and toner particles are charged by injection of charges due to an electrical potential difference existing between a magnetic device on which toner particles are carried and a conductive donor surface which is opposed in a spaced relationship by a predetermined distance to the magnetic device. Then, the charged toner particles are partially transferred from the magnetic device to the conductive donor surface so as to allow the charged toner particles to contact a surface of an electrostatic image supporting member located in opposition to the conductive donor surface to effect developing.

An electrical potential difference applied between the magnetic device and a transfer zone of the conductive donor surface depends upon the specific resistance of toner and ranges from 3000 to 10000 V/cm. In other words, means for charging toner is injection of charges due to an electric field which is applied to the transfer zone between the magnetic device and the conductive donor surface. Similarly to the arrangement of U.S. Pat. No. 4,121,931, in order to charge toner particles, it is necessary to apply a high electric field to a transfer zone in which they exist, and hence, this arrangement presents similar drawbacks.

U.S. Pat. No. 3,909,258 discloses a mono-component developing method which employs conductive magnetic toner. In this method, in a process for developing an electrostatic image with toner, a conductive sleeve is electrically connected to a substrate of a drum on which an electrostatic image is carried so that particles of conductive and magnetic mono-component toner may be supported on a surface of the sleeve by a magnetic force. The drum is located adjacent and in opposition to the sleeve such that the electrostatic image on the drum is spaced by a predetermined fixed distance from the sleeve. An electric field intensity of the electrostatic image is selected such that an electrostatic force by charges of toner particles induced through an electric circuit by the electrostatic image is greater than the magnetic force, thereby enabling development. By the use of conductive toner, an electrostatic image can be easily developed irrespective of the polarity (positive or negative) thereof. However, since the toner is conductive, the sharpness of the image is readily deteriorated due to dispersion of toner particles when the image once developed is transferred, for example, to plain paper, and hence it is difficult to produce a good picture image. "Plain paper" here is defined as paper which is popularly used in present day copiers and which is not processed to have a resin coat for raising the electric resistance of the paper.

SUMMARY OF THE INVENTION

It is an object of the present invention to provide a developing method which enables development of an electrostatic image of a relatively low electric potential using an insulative magnetic mono-component developer.

It is another object of the invention to provide a developing method which enables development of an electrostatic image of a relatively low electrical potential using an insulative magnetic mono-component developer and which enables good development by controlling charging of toner particles by injection of charges due to an electrostatic image field or any other voltage source to attain stabilized charging of toner particles basically independent of such an electric field as described above.

According to the present invention, components used for toner are mainly a resin and a magnetic substance. The resin may be a thermoplastic resin which is good as a binding agent, good for insulation and suitable for heat fixing. The magnetic substance may be powdery particles of a ferromagnetic substance such as ferrite, magnetite and so on. A suitable material may be added to the toner in order to improve the characteristics of the toner. For example, in order to control charging of the toner, a dye such as nigrosine or the like, or a metallic complex salt, naphthenic acid, higher fatty acid salt, or quaternary ammonium salt may be added as a charge control agent. In order to improve parting from a heat roller upon fixing, a parting agent may be added. In order to improve fluidity to prevent agglomeration, a fluidity promoting agent such as hydrophobic silica or the like may be intermixed.

The toner used for developing an electrostatic image according to the present invention has such characteristics that an electrical potential produced by mutual friction of toner particles is high and the polarity of the charge is mono-polar so that, under an electric field required for development between a drum and a sleeve, the electrical potential of the toner produced by friction has much greater influence on the entire electrical potential of the toner than the electrical potential of the toner produced by injection of charges due to the electric field between the drum and the sleeve. Such friction of toner particles as described above appears principally against the sleeve among elements of the developing device with which toner particles are in contact.

If the electrical potential of the toner produced only by friction (frictional electrical potential, hereafter) when there exists no electric field between the drum and the sleeve is represented by VF (V) and the electrical potential of the toner produced only by injection of charges due to an electric field necessary to deposit the toner on the drum when such an electric field exists between the drum and the sleeve is represented by Vi (V), then the electrical potential Vt (V) of the toner when the toner deposits on the drum is indicated by $Vt=Vf+Vi$. Where a "frictional charging index a" is defined as $a=Vf/Vt=(Vt-Vi)/Vt$, it is preferable to use a toner which has a charging index at least $a>0.7$.

According to the invention, the drum and the sleeve are spaced a particular fixed distance from each other and are located in opposition to each other, and toner is continuously supplied between the drum and the sleeve while the sleeve is being rotated. Particles of the toner are attracted to the sleeve by a magnetism generating means (hereinafter referred to as a magnet roll) located inside the sleeve and thus form hills of toner particles on the sleeve. At least some parts of hills of the toner particles are in contact with the drum to effect development. Electric charges are given to the toner by contact friction between the toner and the sleeve or a regulating blade while the sleeve, magnet roll or the like is being rotated. In order to strengthen the frictional charging effect, a material such as a charge control agent is added to the toner. The surface of the sleeve may be roughened to further promote the frictional charging effect. Such means as described just above causes a high frictional electrical potential on the toner and enables development with an electric field intensity which is lower by the electrical potential caused by friction compared with the case wherein the toner is charged with electricity due to an effect of injection of charges by an electric field existing between the sleeve and the drum, making it possible to obtain an intense picture image.

In addition, a mono-component developing method employing insulative magnetic toner according to the present invention enables development of an electrostatic image of a relatively low electrical potential and assures a stabilized frictional electrical potential having less dispersion without the electrical potential of the toner being influenced by various conditions such as an electric field existing between the sleeve and the drum. In order to obtain an absolute value of a high frictional electrical potential and maintain the same at a fixed level even if there exists an electric field, a method is employed wherein, when the sleeve is rotated to carry the toner, a thin fixed layer of toner basically unmovable relative to the sleeve is formed on the sleeve so as to allow charging of the toner by friction of the fixed layer with a movable layer of the toner which is formed on the fixed layer and can relatively freely move relative to the sleeve. By this method, stabilized charge of the toner can be attained.

If the magnitude of the electric field between the sleeve and the drum is represented by Eo (V/cm) and the electrical potential of the entire toner when the electric field exists is represented by Vt (V), where the field-depending index b which shows a ratio of a coefficient of variation ΔVt of Vt relative to a coefficient of variation ΔEo of Eo is given by $b=|\Delta Vt/\Delta Eo|$, it is preferable to use a toner having characteristics which meet at least the condition $a<1.0\times10^{-3}$.

BRIEF DESCRIPTION OF THE DRAWINGS

FIG. 7 is a diagram illustrating a method of calculating the frictional charging index, a;

DESCRIPTION OF THE PREFERRED EMBODIMENTS

Now, concrete preferred embodiments of the present invention will be described.

Figure 1:
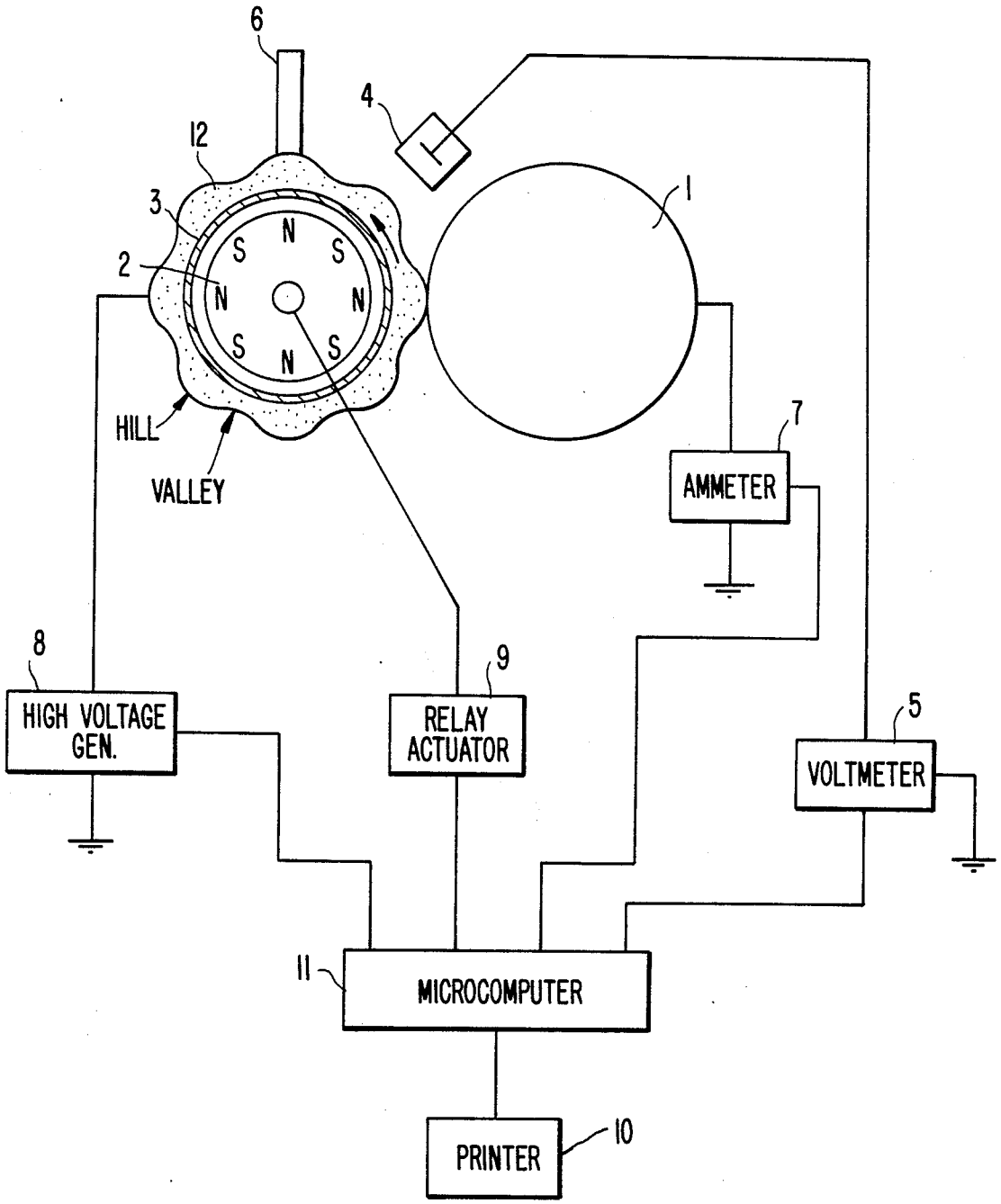
FIG. 1 is a schematic view of a device for measuring the charged electrical potential and a dynamic electric current of toner in accordance with a developing method of the present invention.

It was examined how the dynamic current and the electrical potential of toner are varied by an electric field existing between a sleeve and a drum. A device for measuring the dynamic current and the electrical potential of toner is illustrated in FIG. 1. In FIG. 1, reference numeral 1 denotes a drum electrode which is an aluminum cylinder, the drum electrode 1 being in a stationary condition. Reference numeral 2 denotes a magnet roll serving as a magnetism generating means. Reference numeral 3 denotes a sleeve which is rotating in a counterclockwise direction so as to allow observation of the electrical potential of toner just after it has passed a zone in which an electric field between the drum electrode 1 and the sleeve 3 exists. Reference numeral 4 denotes a surface potential probe for observing the electrical potential of toner, and 5 an electrostatic voltmeter (TREC, MODEL 344). The sleeve 3 may be rotated in a clockwise direction if the drum 1 and the potential probe 4 are reversely positioned relative to each other. Reference numeral 6 denotes a regulating blade for controlling the thickness of a layer of toner. The distance between the regulating blade 6 and the sleeve 3 is represented as BSD while the distance between the drum electrode 1 and the sleeve 3 is represented as DSD. Reference numeral 7 denotes an ampere meter for monitoring the dynamic current flowing into and from the drum, 8 a high voltage generating device (TREC, 610B) for providing a bias Vo (V) to the sleeve, 9 a relay actuator (Hewlett Packard, Model 59036A) for controlling rotation of the sleeve, 10 a printer (Hewlett Packard, Model 7245B plotter printer), and 11 sa microcomputer (Hewlett Packard, Model 9826) which receives and processes data values from the electrostatic voltmeter 5 and the ampere meter 7 and outputs data to the printer 10 while it controls a voltage to be outputted from the high voltage generating device 8 and provides an operation instruction to the relay actuator 9 to control rotation of the sleeve. Reference numeral 12 denotes a toner layer which is attracted to the drum by a magnetic force. The thickness of the toner layer is controlled by the regulating blade 6. At portions of the toner layer 12 near magnetic poles of the magnetic roll 2, ears of toner stand or extend radially and contact with the drum electrode 1.

Table 1 shows various conditions for the measurement.

TABLE 1

| | |
|---|---|
| Blade-sleeve distance (BSD) | 0.3 mm |
| Drum-sleeve distance (DSD) | 0.4 mm |
| Diameter of sleeve | 31.5 mm |
| Diameter of drum | 100 mm |

TABLE 1-continued

| | |
|---|---|
| Revolution of sleeve | 226 rpm<br>116 rpm<br>50 rpm |
| Magnetic flux of magnet roll | 600 Gauss |
| Revolution of magnet roll | Stationary |
| Revolution of drum | Stationary |

Table 2 shows the composition of materials of the insulative toner which was used in the examinations. After steps of mixing, melting, kneading, pulverizing and classifying, powder having an average grain size of 12 to 13 microns is obtained. To 100 weight parts of the powder thus obtained, hydrophobic colloid silica in weight parts as shown in Table 2 are added as a fluidity promoting agent. Toner B and toner C are toners which are obtained by adding a toner A charge control agents for providing positive and negative charging actions, respectively. Thus, the toner B and toner C have characteristics to be charged positively and negatively, respectively. The toner A was prepared in accordance with the toner composition as disclosed in U.S. Pat. No. 4,121,931 while toner E was prepared in accordance with the toner composition as disclosed in U.S. Pat. No. 4,259,427. U.S. Pat. No. 4,259,427 described that the toner disclosed therein is charged with electricity by mutual friction of particles thereof. Toner D is a toner which is obtained by adding to toner A another charge control agent having a different negative charging action from the charge control agent for the toner C.

TABLE 2

| Toner | B | C | D | A | E |
|---|---|---|---|---|---|
| Resin | | | | | |
| Material | a | a | b | a | a |
| Weight ratio | 40 | 40 | 40 | 40 | 40 |
| Magnetic substance | | | | | |
| Material | c | c | c | c | d |
| Weight ratio | 60 | 60 | 60 | 60 | 60 |
| Charge control agent | | | | | |
| Material | e | f | g | — | — |
| Weight ratio | 5 | 3 | 3 | — | — |
| Fluidity-promoting agent | | | | | |
| Weight ratio | 0.5 | 0.5 | 0.5 | 0.5 | 0.5 |

a: Epikote 1004 (Epoxy resin by shell chemical Co.).
b: TR-0586 (Styrene-acrylic resin by Nippon Zeon Co.)
c: EPT-500 (Magnetite by Toda Kogyo Corp.)
d: Mapiko Black (Magnetite by Columbia Carbon Co.)
e: Bontron No. 7 (By Orient Chemical Industries Ltd.)
f: Spiron TRH (By Hodogaya Chemical Co.)
g: Spiroon TVH (By Hodogaya Chemical Co.)

The specific resistance ranged from $10^{13}$ to $10^{15}$ Ωcm for all the toners A, B, C, D and E under 10000 V/cm.

The procedure for the measurement was as follows:

(1) the bias voltage Vo was applied to the sleeve;

(2) the sleeve was rotated at a predetermined fixed rotational speed;

(3) while the sleeve was rotated for a fixed period of time, data of the dynamic current I and the electrical potential Vs was taken into the microcomputer, the direction of the current which flows from the drum to ground being defined as positive;

(4) the sleeve was stopped and the bias voltage was reduced to zero;

(5) in this condition, the electrical potential Vt of toner was measured again (this was done in order to allow comparison with Vt of a value Vs-Vo, that is, a value after Vo is subtracted from Vs which is measured while the bias voltage Vo is applied to the sleeve; both present substantially same characteristic values); and (6) the operations of the above steps from 1 to 5 was repeated within a range of Vo=−1000 to +1000 V.

Measured values obtained by the measuring procedure described above will be described in detail below.

Figure 2A:
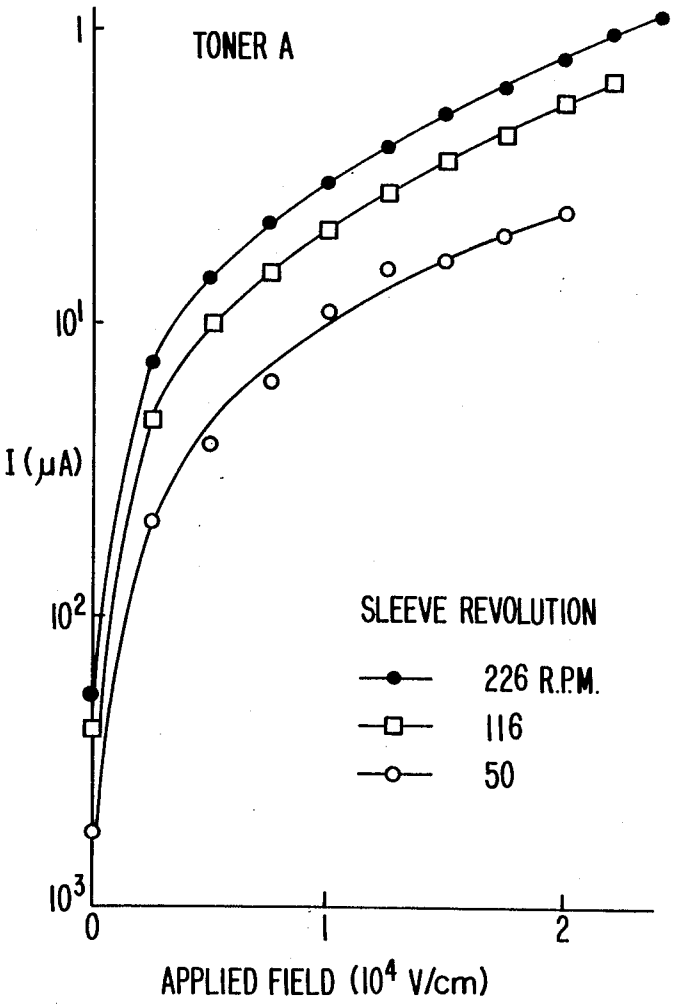
FIG. 2*a*, FIG. 2*b*, FIG. 3*a*, FIG. 3*b*, FIG. 4*a* and FIG. 4*b* are diagrams illustrating plots of dynamic electric currents of toner relative to applied electric fields for various rotational frequencies of the sleeve.
Figure 2B:
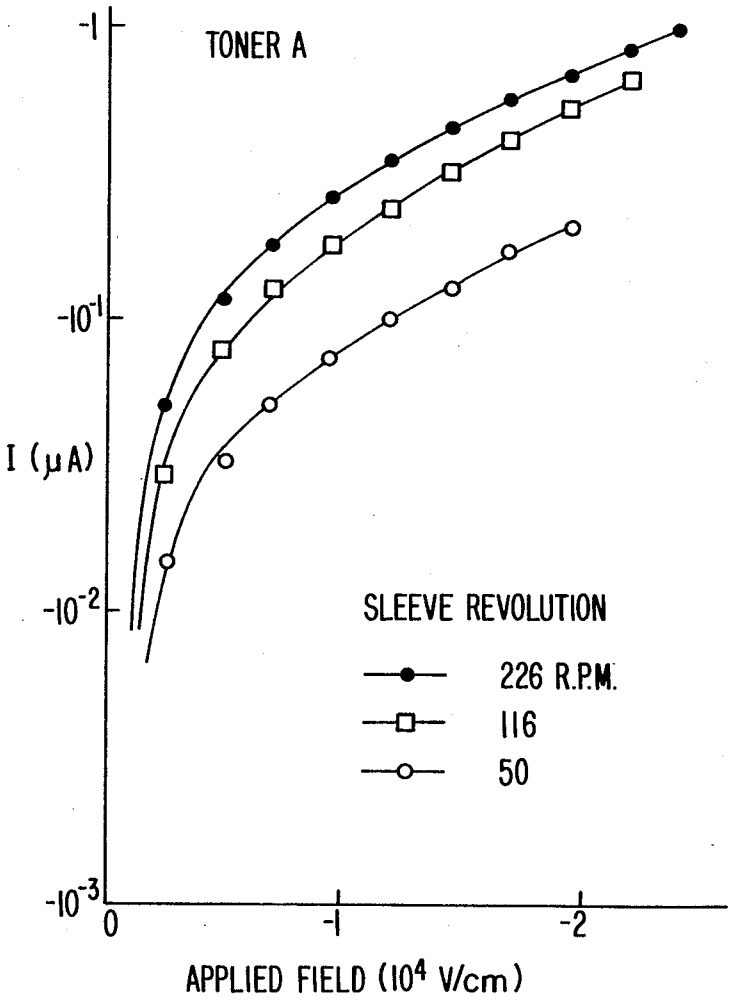
Figure 3A:
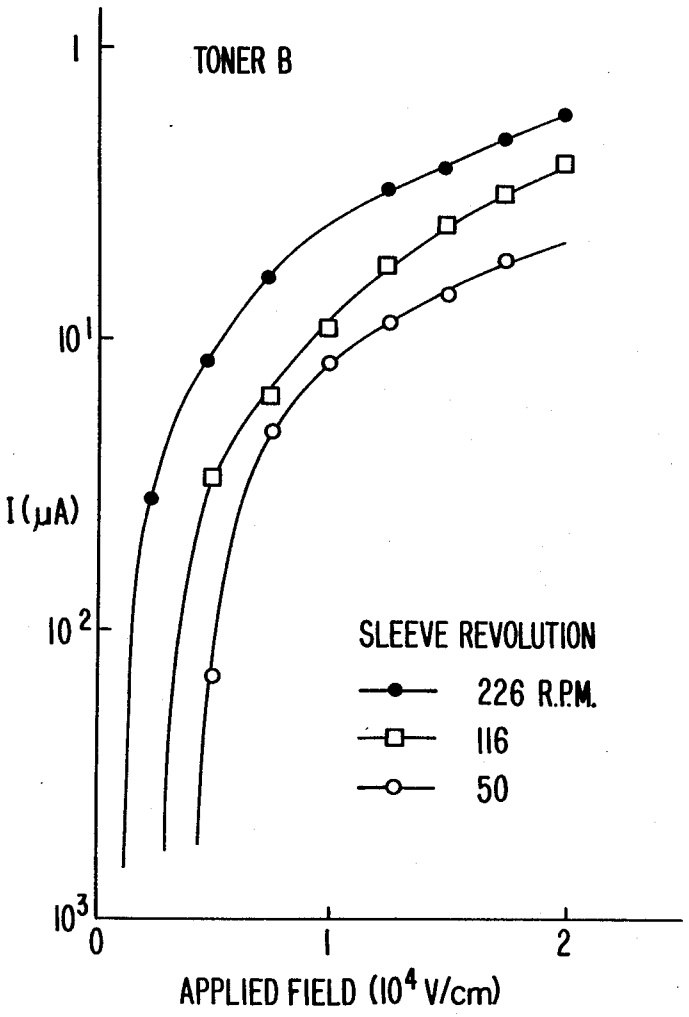
Figure 3B:
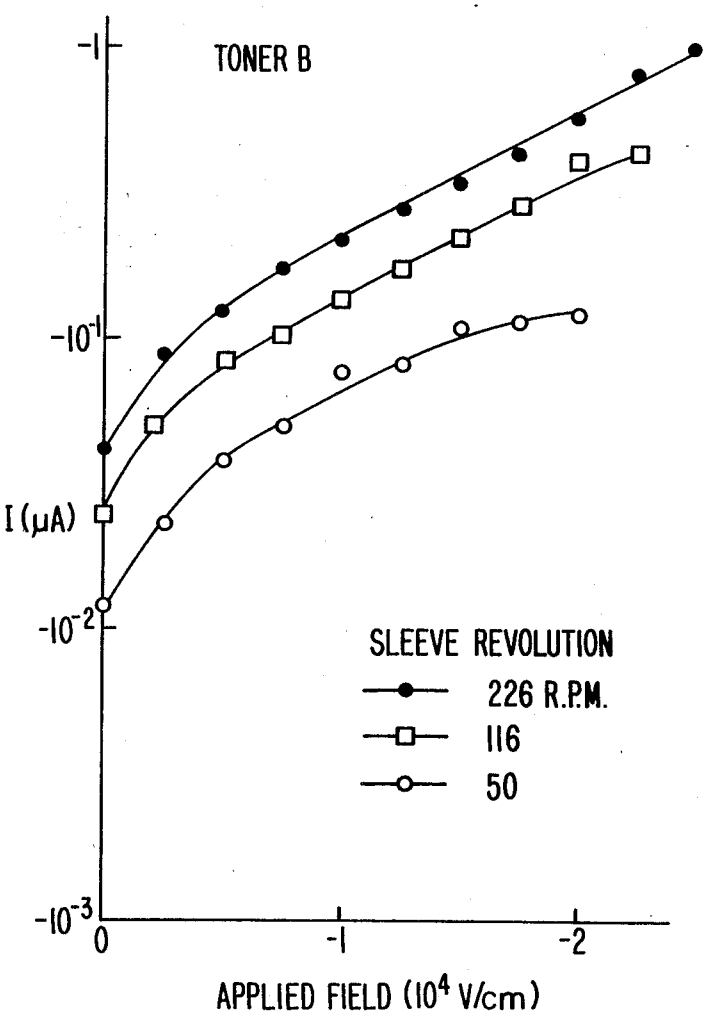
Figure 4B:
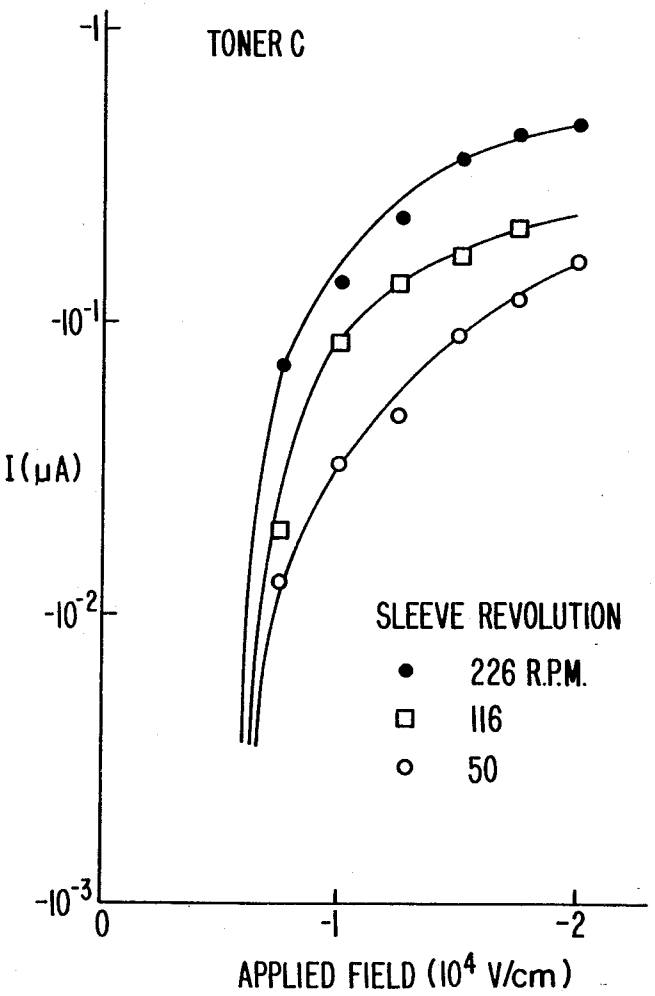
Figure 4A:
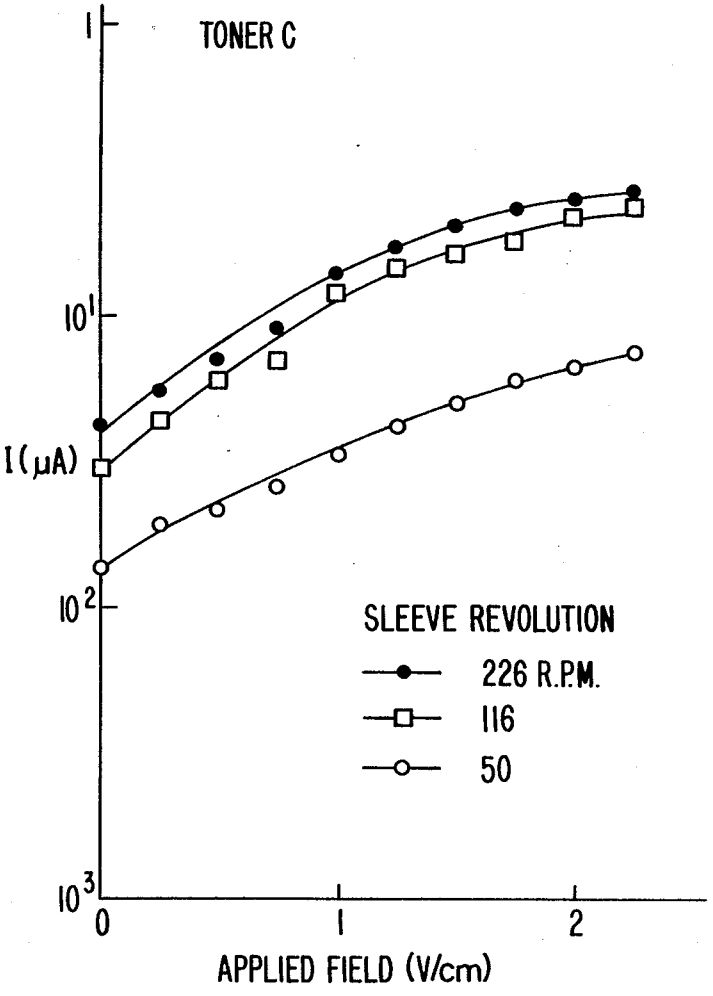

FIGS. 2(*a*) to 4(*b*) illustrate dynamic currents of the toners A, B and C measured in accordance with U.S. Pat. No. 4,121,931. In particular, FIG. 2(*a*) and FIG. 2(*b*) illustrate dynamic currents of the toner A, FIG. 3(*a*) and FIG. 3(*b*) those of the toner B, and FIG. 4(*a*) and FIG. 4(*b*) those of the toner C. In this instance, there were three different rotational speeds of the sleeve; they were 50, 116 and 226 rpm. The figures which include a character "(a)" in the figure numbers are the cases in which the bias voltage Vo is positive while those which include "(b)" are the cases in which the bias voltage Vo is negative. The abscissa represents the value of an electric field which is obtained by dividing the bias voltage Vo by the gap DSD between the drum and sleeve while the ordinate represents the dynamic current I.

It can be observed that as the absolute value of the electric field increases, the absolute value of the dynamic current I increases, and as the rotational frequency of the sleeve increases, the dynamic current I increases. With the toner A which was not processed to increase frictional charge, or in other words, which has no charge control agent added thereto, there is little dynamic current due to frictional charge when there is no applied electric field (Vo=0). But the toners B and C present higher values of dynamic current due to frictional charge compared with the toner A.

In the experiments described above, the measurement was done with a drum electrode in the form of a conductive aluminum cylinder. However, in an actual copier, an electrostatic latent image supporting member is formed as a photosensitive drum which has an insulative photoconductor layer provided on a surface thereof. Thus, since an insulative layer exists on the drum, injection of charges never occurs from the drum onto the toner. Use of conductive drum electrode will cause injection of charges from the drum and is not suitable for an actual copier. Accordingly, in the following measurement of electrical potentials of toner, a method of measuring an electrical potential of toner on the sleeve without contacting the toner with the drum was employed to eliminate influences of injection of charges from the drum in consideration of such circumstances as described above. In this instance, in order to attain the same DSD as in the measurement of the dynamic currents described above, a valley portion between hills of toner was opposed to the drum. The hills of toner layer were formed near magnetic poles of the magnet roll while the valleys of the toner were formed near the centers of the magnetic poles of the magnet roll. While in FIG. 1 mentioned hereinabove a hill of toner was in contact with the drum electrode 1, in the following measurement, a valley of toner was opposed to the drum electrode 1, and the measurement was thus done without contacting the toner with the drum.

Figure 6:
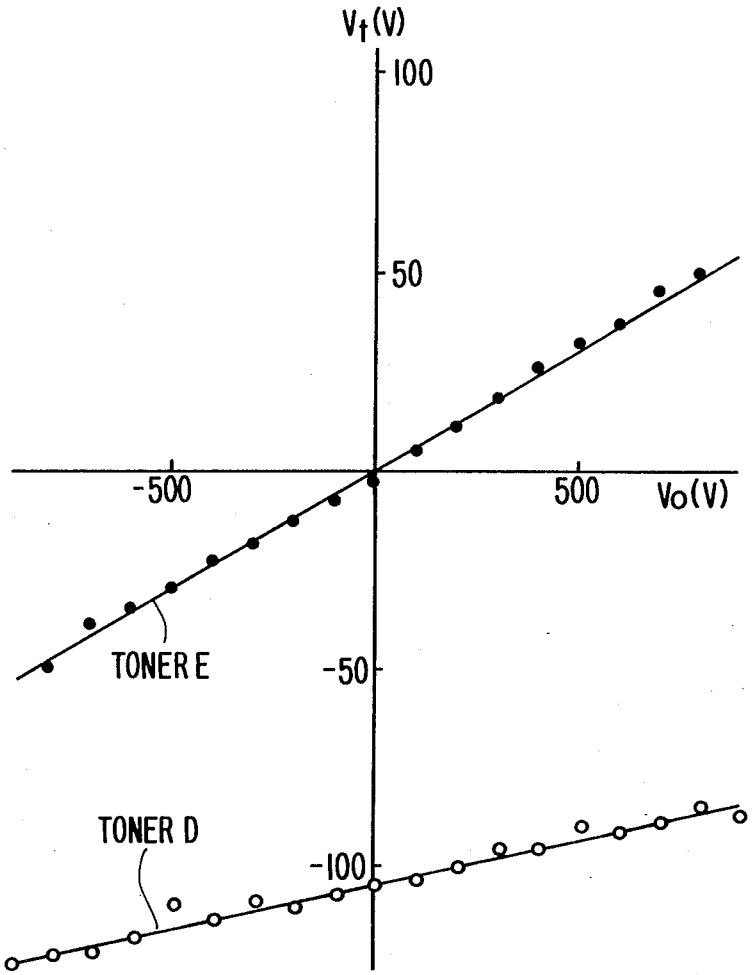
FIG. 5 and FIG. 6 are diagrams illustrating plots of electrical potentials of toner on the rotating sleeve relative to voltages applied to the sleeve.
Figure 5:
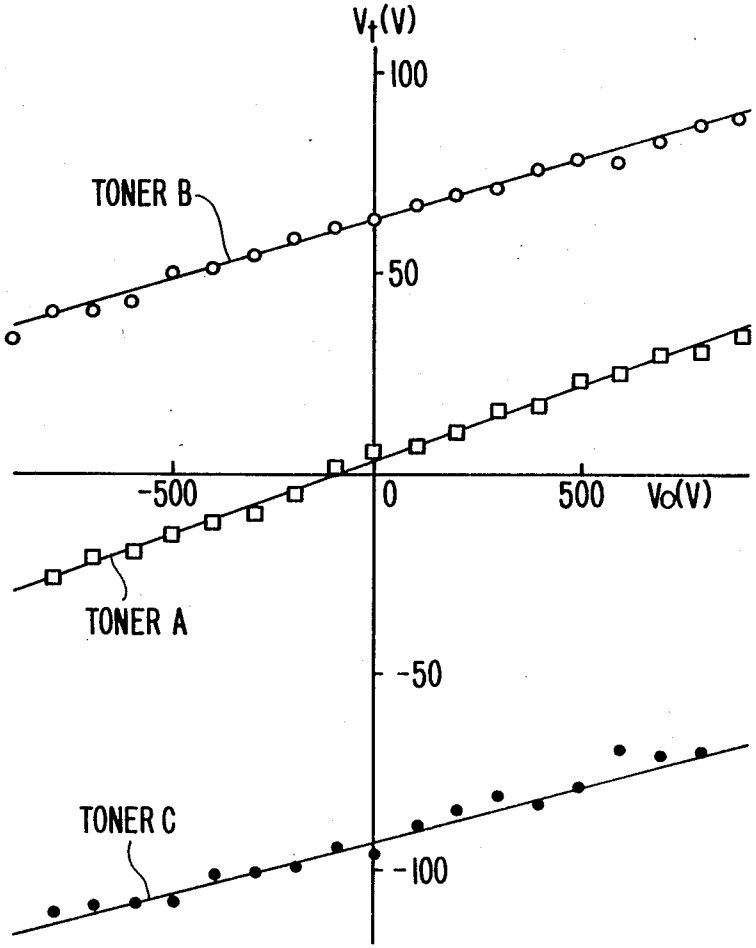

FIG. 5 illustrates fluctuations of the electrical potential of the toners A, B and C relative to the bias voltage applied to the sleeve, and FIG. 6 illustrates those of the toners D and E. The rotational speed of the drum in FIGS. 5 and 6, was 116 rpm. Here, the abscissa represents the bias voltage applied to the sleeve in order to see the bias voltage applied to the sleeve when toner deposits on the drum. The measurement in connection with deposit of toner on the drum will be hereinafter described.

In FIG. 5, when Vo=0, little electrical potential due to friction appears in the toner A. However, in the toner B and the toner C, it can be seen that the frictional electrical potential presents a high absolute value of several tens V (about 60 V for toner B, about 90 V for toner C) compared with that of the toner A due to an effect of addition of a charge control agent. In every toner, the electrical potential increases in proportion to the increase of the bias voltage applied to the sleeve, and this occurs from the influence of an electric field existing between the sleeve and the drum, and thus fluctuations of the electrical potential of toner due to injection of charges are shown. The toner D of FIG. 6 presents similar characteristics to those of the toner C and the absolute value of the frictional electrical potential presents a high value of about 100 V.

If the toner E is charged by mutual friction of particles thereof, positively charged particles and negatively charged particles are present in the toner, and the electrical potential of the entire toner is offset and has a low value. The toner E has characteristics very similar to those of the toner A and has a characteristic that the electrical potential of toner depends upon the bias voltage applied to the sleeve due to the influence of injection of charges into the toner from the sleeve.

The frictional charging index a will be described below. Referring to FIGS. 5 and 6, the electrical potential of toner produced only by friction when the electric field between the sleeve and the drum is zero so that there is no injection of charges is represented Vf. This is a value of Vt when Vo=0 and indicates intercepts of the individual characteristics. If the bias voltage Vo applied to the sleeve is increased, the toner undergoes injection of charges due to an electric field existing between the drum and the sleeve, raising the charged electric potential thereof. In this instance, the charged electric potential of the entire toner is the sum of the charged electric potential caused by the injection of charges and the charged electric potential caused by friction.

If the electrical potential of the entire toner is represented by Vt when the bias is raised until a developing condition in which the toner which is contacted with the conductive aluminum drum electrode can deposit on the drum, and the value of Vt from which the electrical potential Vf of the toner which is produced by friction when Vo=0 is subtracted is represented as Vi, then Vi is the electrical potential of the toner produced by injection of charges from the conductive sleeve with the bias voltage during development, Vt can be represented as $Vt=Vf+Vi$. The frictional charging index a defined by a=Vf/Vt is an index which indicates what degree the frictional electrical potential occupies relative to the electrical potential of the entire toner during development. Measurements of Vt, Vf and Vi were conducted with the drum not in contact with the toner and Vd was measured with the drum in contact with the toner, and the frictional charging index was calculated on the characteristic diagrams of Vt and Vo conducted with the drum not in contact with the toner, using the value Vd.

Figure 7:
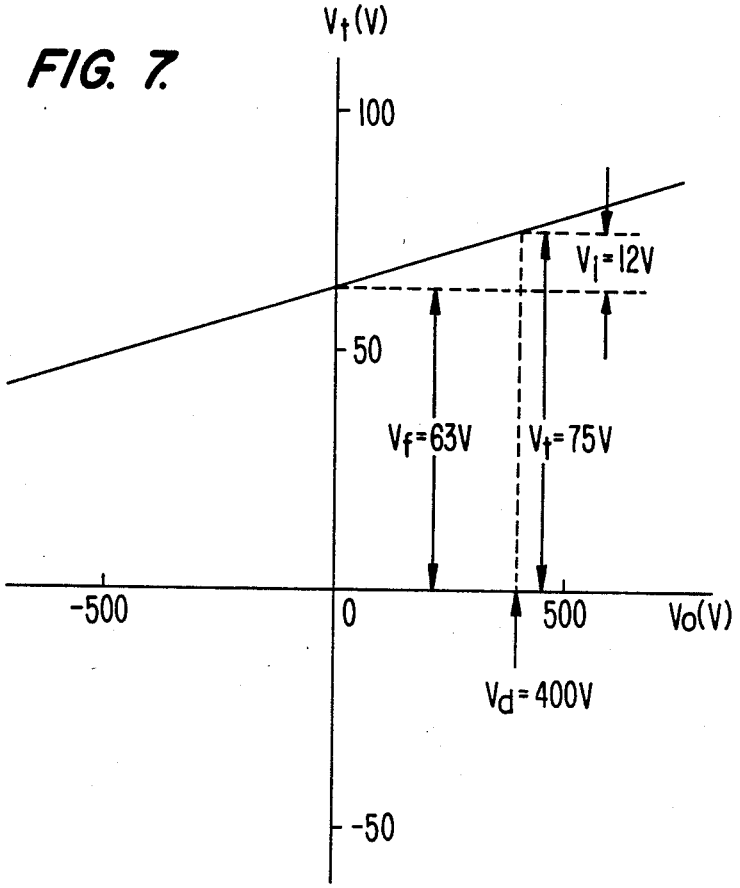

FIG. 7 illustrates characteristics of the toner B of FIG. 5 in a modeled manner. If the bias voltage Vo when the toner begins to deposit on the drum is represented as Vd, since the toner B has Vd=+400 V and the electrical potential Vt of the toner then is +75 V while the electrical potential Vf produced only by friction when Vo=0 is +63 V, the value Vi of the Vf subtracted from Vt is the electrical potential of the toner produced only by injection of charges with $Vo=+400$ V, and $Vi=+12$ V. Accordingly, the frictional charging index becomes a=0.84. The characteristics of the individual toners are indicated in Table 3.

TABLE 3

| Toner | B | C | D | A | E |
|---|---|---|---|---|---|
| $V_d$ (V) | +400 | −300 | −300 | +900 | +500 |
| $V_f$ (V) | +63 | −93 | −105 | +3 | +1 |
| $V_i$ (V) | +12 | −8 | −6 | +34 | +29 |
| $V_t$ (V) | +75 | −101 | −111 | +37 | +30 |
| a | 0.84 | 0.92 | 0.95 | 0.08 | 0.03 |

In the toner A, since an electrical potential produced by friction contributes little to development while that produced by the injection of charges contributes much, the index a is a low value of a=0.08, necessitating a high electric field for development.

On the other hand, a=0.84 in the toner B and a=0.92 in the toner C and hence the ratio of the electrical potential of the toner produced by injection of charges which contributes to development is low, while the electrical potential of the toner produced by friction contributes much to development, allowing development with an electric field of a low electrical potential. The toner D has substantially similar characteristics to those of the toner C, and a=0.95. In the toner E, while the index a is a low value of a=0.03, particles thereof are charged partly positive and partly negative by friction, allowing development with a low bias voltage application. But the toner E has such defects as mentioned in the description of the prior art, and hence cannot be said to be a very good toner.

In the measurement described above, while a bias voltage is applied to the sleeve as means for observing electrical potential characteristics of toners by an electric field, it may otherwise be applied to the drum, and similar effects can be attained with an electrostatic latent image where the drum is a photoconductor.

By providing toner with the frictional charging effect, development can be attained for an electrostatic image of the electrical potential which is half or less of the electrical potential required for a method of effecting development by injecting charges into the toner to charge the toner. The measurement of deposition of toner on the drum was effected with the drum contacted by a hill of the toner as seen in FIG. 1. As shown in Table 3. deposition of toner on the drum requires a sleeve bias voltage application of +900 V of the toner A, +400 V for the toner B, −300 V for the toner C and −300 V for the toner D. Thus, development is possible at a low electrical potential with the toners B, C and D, and deposition of toner of a high intensity can be attained.

In order to measure the efficiency that toner which has deposited on the drum in development step is used for a copy image in a transfer step and to observe a picture image, development was conducted with a magnetic brush of toner on the sleeve contacted with a photoconductor, using selenium for the positively chargeable photoconductor, an organic photo conductor for the negatively chargeable photoconductor, and an FP-1300 copier (by Matsushita Electric Industrial Co.) for the copying machine. As a result, the efficiency was 75 to 80% for the toners B, C and D. Copy images had high intensities of 1.4 or more in reflection density. In addition, no deposition of toner was found around the copy image, and thus a good copy image with little blurring was obtained.

Now, a further improved method of charging toner will be described in detail from the point of view of putting the invention into practice.

Figure 8:
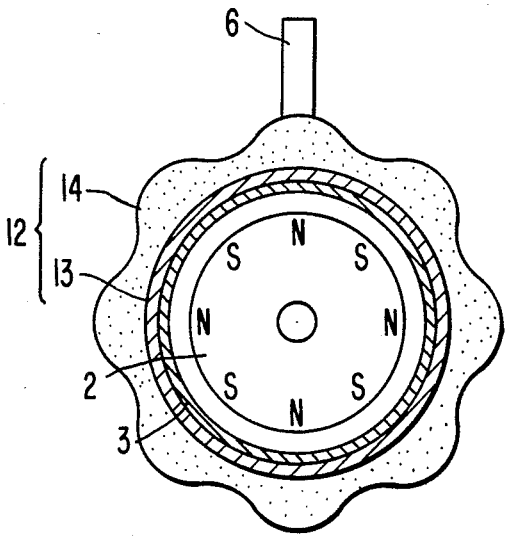
FIG. 8 is a schematic view illustrating construction of a toner layer on the sleeve.

According to the present invention, the drum and the sleeve are spaced a particular fixed distance from each other and are located in opposition to each other, and toner is continuously supplied between the drum and the sleeve. Particles of the toner are attracted to the sleeve by the magnet roll and thus form hills of toner particles on the sleeve. At least parts of the hills of toner particles are in contact with the drum to effect development. Where a layer of toner on the toner is divided into two layers as seen in FIG. 8 when the sleeve and the magnet roll are rotated to provide a physically intermixing action to the toner, the toner is charged with electricity by frictional contact between a lower fixed one of the layers which is basically unmovable relative to the sleeve and the other upper layer which exists on the fixed toner layer and is movable relatively freely relative to the sleeve.

if the present method is used, a sufficient electrical potential can be obtained by friction between the toner layer fixed on the sleeve and the other movable layer which can relatively freely move relative to the sleeve. Besides, while toner to which the present invention does not apply exhibits a phenomenon that when it repetitively contacts the sleeve, it undergoes injection of charges from the conductive sleeve due to an electric field existing between the sleeve and the drum so that an electrical potential of the toner varies, according to the toner of the invention, injection of charges into the toner due to an electric field between the sleeve and the drum is prevented by the toner layer fixed on the sleeve, and the toner is not influenced by the effect of injection of charges, causing no dispersion of the electrical potential of the toner, assuring that a stabilized frictional electrical potential is maintained. Accordingly, a good copy image of a high density can be obtained.

Now, conditions of toner on the sleeve charged by an electric field between the sleeve and a drum depending upon the mode of the toner on the sleeve as described above will be described.

A device used for measurement of the charge of toner was the same as that of FIG. 1 described hereinabove.

However, toner 12 on the sleeve includes, as seen in FIG. 8, a toner layer 14 which is relatively freely movable relative to the sleeve 3, and the other toner layer 14 which is fixed and unmovable relative to the sleeve. If the outer toner layer 14 is removed, it can be observed with the naked eye that the fixed toner layer 13 is formed in a thin layer.

Table 4 indicates various conditions for the measurement.

TABLE 4

| | |
|---|---|
| Blade-sleeve distance (BSD) | 0.3 mm |
| Drum-sleeve distance (DSD) | 0.4–0.5 mm |
| Diameter of sleeve | 31.5 mm |
| Diameter of drum | 100 mm |
| Revolution of sleeve | 116 rpm |
| Magnetic flux of magnet roll | 1000 Gauss or 600 Gauss |

TABLE 4-continued

| | |
|---|---|
| Revolution of magnet roll | Stationary |
| Revolution of drum | Stationary |

Table 5 indicates compositions of toners used.

TABLE 5

| Toner | F | G | H | A | E |
|---|---|---|---|---|---|
| Resin | | | | | |
| Material | h | b | b | a | a |
| Weight ratio | 60 | 60 | 79 | 40 | 40 |
| Magnetic substance | | | | | |
| Material | i | i | j | c | d |
| Weight ratio | 39 | 39 | 20 | 60 | 60 |
| Charge control agent | | | | | |
| Material | f | f | f | — | — |
| Weight ratio | 1 | 1 | 1 | | |
| Fluidity-promoting agent | | | | | |
| Weight ratio | 0.5 | 0.5 | 0.5 | 0.5 | 0.5 |

a: Epikote 1004 (Epoxy resin by Shell Chemical Co.)
b: TR-0586 (Styrene-acrylic resin by Nippon Zeon Co.)
c: EPT-500 (Magnetite by Toda Kogyo Corp.)
d: Mapiko Black (Magnetite by Columbia Carbon Co.)
f: Spiron TRH (By Hodogaya Chemical Co.)
h: NC-6100 (Styrene-acrylic resin by Nippon Carbide Co.)
i: TB-RVB (Magnetite by Tone Industries Co.)
j: KBC-1000 (Iron powder by Kanto Denka Kogyo Co.)

The procedures for measurement of charging toner were substantially the same as those described hereinabove except that the dynamic current was not measured between the drum and ground.

As described hereinabove, in a copier, a photoconductive layer of an electrostatic latent image supporting member acts as an insulator. Accordingly no injection of charge from the drum occurs.

In order to eliminate injection of charges from the drum electrode 1 into the toner layer 12, also in this case, a valley of the toner layer was opposed to the drum electrode, and thus measurement was conducted without contacting the toner with the drum.

Figure 9:
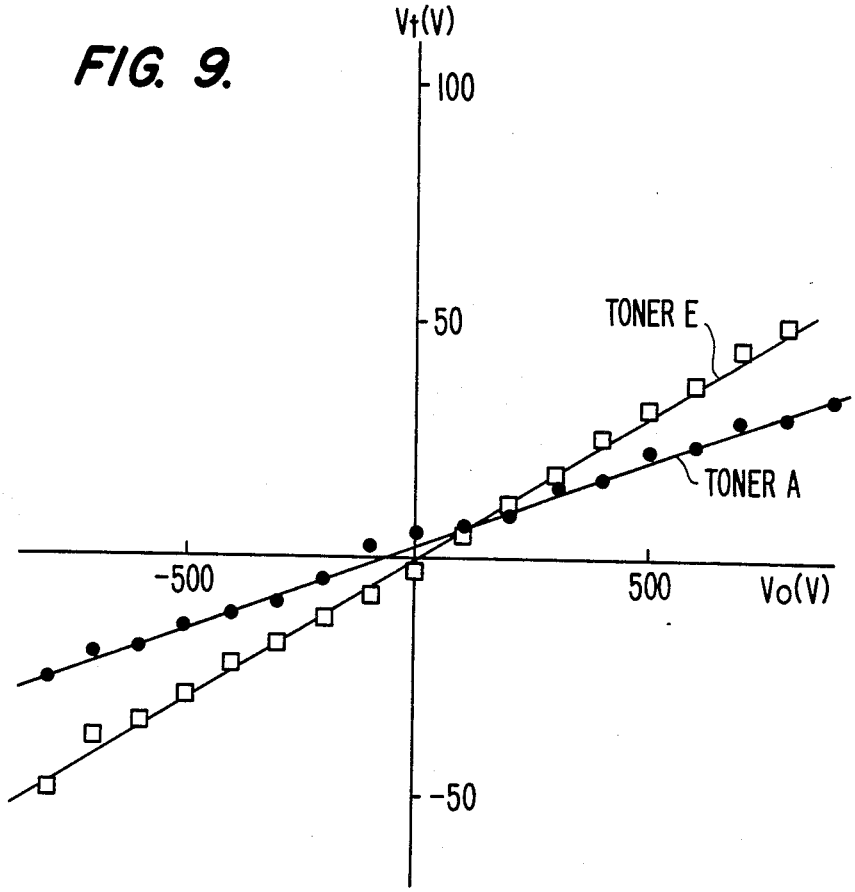
FIG. 9 and FIG. 10 are diagrams illustrating plots of electrical potentials of toner on the rotating sleeve relative to voltages applied to the sleeve.
Figure 10:
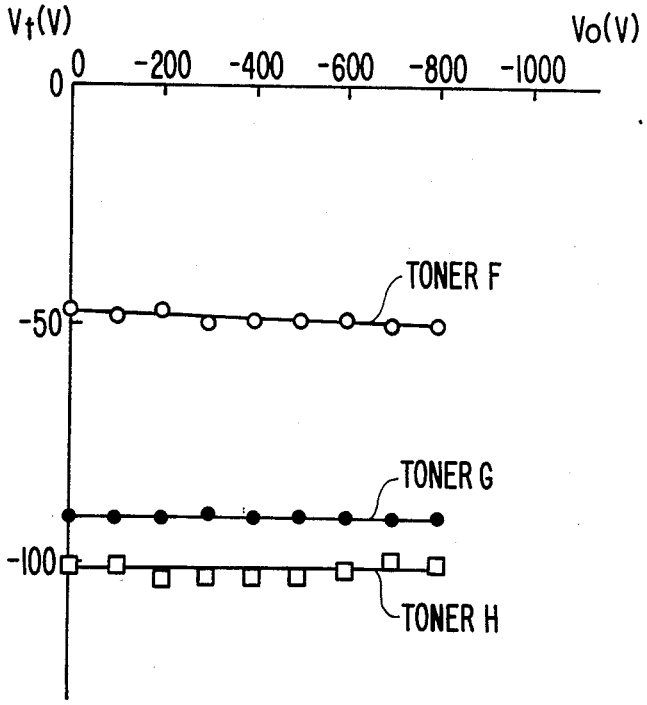

FIG. 9 shows again the relations of the electrical potential Vt of the toner on the sleeve relative to the bias voltage Vo applied to the sleeve for the toner A of FIG. 5 and the toner E of FIG. 6, while FIG. 10 illustrates relations of the electrical potential of the toner on the sleeve relative to the bias voltage applied to the sleeve for the toners F, G and H. In this case, a magnet roll of 1000 Gauss was used. The electric field Eo between the sleeve and the drum was the sleeve voltage Vo divided by the distance DSD between the sleeve and the drum. An absolute value $|\Delta Vt/\Delta Eo|$ when a coefficient of variation $\Delta Eo$ of the electric field Eo between the sleeve and the drum is divided by a coefficient of variation $\Delta Vt$ of the electrical potential of the toner is defined as a field-depending index b. The characteristics of FIGS. 9 and 10 present linear lines, and hence the indexes b indicate absolute values of gradients of the linear lines. The larger the value of b, the larger the change of the electrical potential of the toner produced by injection of charges due to an electric field.

Table 6 indicates field depending indexes of the individual toners.

TABLE 6

| Toner | Field-depending Index b |
|---|---|
| F | $3.1 \times 10^{-4}$ |
| G | $6.3 \times 10^{-5}$ |
| H | $1.3 \times 10^{-4}$ |
| A | $1.5 \times 10^{-3}$ |

TABLE 6-continued

| Toner | Field-depending Index b |
|---|---|
| E | $2.4 \times 10^{-3}$ |

In both the toners A and E, the electrical potential of the toner rises as the bias voltage applied to the sleeve increases, and $b=1.5\times10^{-3}$ for the toner A and $b=2.4\times10^{-3}$ for the toner E. Such variations indicate variations caused by injection of charges from the sleeve into the toner. In the toner A, most of the electrical potential of the toner necessary for development is produced by injection of charges from the sleeve, and since the electrical potential is of a low level, it is necessary to apply a bias of a high electrical potential to the sleeve in order to attain sufficient deposition of the toner on the drum electrode. Accordingly, where an electrostatic image supporting member such as a photosensitive member is used, an electrostatic latent image of a high electrical potential is necessary to provide a high electric field to the toner on the sleeve. Further, since deposition of the toner on the drum occurs suddenly from a certain electrical potential, reproduction of an intermediate tone becomes difficult. Meanwhile, in the toner E, there exist positively charged toner particles and negatively charged toner particles caused by friction between those toner particles, and thus development at a low bias voltage is possible, but as described hereinabove, the toner has drawbacks in copy images and consumption of the toner. In this manner, in both the toners A and E, there occur variations in the electrical potential of the toner produced by injection of charges from the sleeve. Since such variations will have an influence on copy images, the toner cannot be said to be a good toner. It is to be noted that, for the toners A and E, measurements were conducted with a DSD of 0.4 mm as has been described above.

Characteristics of the toners F, G and H according to the present invention will be described below with reference to FIG. 10. Those toners are all negatively chargeable toners. Normally, in a copier, where the charging polarity of toner is negative, an electrical potential corresponding to a copy image portion on a drum to be developed is designed to be positive. In this relation, in the measuring instruments in this specification, the sleeve voltage corresponds to the negative. Accordingly, FIG. 10 illustrates characteristics where Vo is negative.

When an electric field of the designed polarities to which a bias voltage of the same polarity as the frictional charging of the toner is applied to the sleeve exists between the sleeve and the drum, the electrical potential of the toner continues to hold a value of a potential by friction when the bias voltage is zero. The frictional electrical potentials of the toners when there is no electric field present show high absolute values such as about −50 V for toner F, about −90 V for toner G and about −100 V for toner H. As for the field-depending indices, they are $b=3.1\times10^{-4}$ for toner F, $b=6.3\times10^{-5}$ for toner G, and $b=1.3\times10^{-4}$ for toner H. Every toner has a low value, and thus the electrical potential of the toner exhibits little changes with fluctuations of the electric field. It can be seen that even if the electric field between the sleeve and the drum is varied, the electrical potential of the toner is not influenced thereby and exhibits little changes, presenting substantially a fixed value. In other words, it can be seen that there occurs no injection of electric charges from the sleeve into the toner. In this instance, the DSD is 0.5 mm.

On the sleeve, a fixed toner layer which is unmovable relative to the sleeve acts as an insulating layer which prevents injection of electric charges from the sleeve into the toner. Charging of the toner is attained by friction between the fixed layer and the movable layer of toner, and thus stabilized frictional charging can always be attained.

The following experiments to deposit toner on a drum were conducted with the drum being in contact with a hill of toner as seen in FIG. 1. Deposition of toner onto the drum is possible with a bias voltage −200 V to −300 V applied to a sleeve for the toners F, G and H. As already mentioned, the toner E required a bias voltage of higher than +500 V and the toner A required a bias of higher than +900 V. Thus, the toners F, G and H prove that development at a low potential is possible.

In order to measure the efficiency with which toner deposited on the drum during the development step is used for a copied image during the transfer step and to observe an actual picture image, development was conducted with a magnetic brush of toner on the sleeve contacted with the photosensitive member, using an FP-1300 copying machine (by Matsushita Electric Industrial Co.). Selenium was used for the positively chargeable photosensitive member while an organic photo semiconductor was used for the negatively chargeable photosensitive member. An efficiency with which toner deposited to the drum during the development step was used for a copy image during the transfer step was measured, and ranged from 75 to 80% for the toners F, G and H. The picture images had a high reflection density of 1.4 or more. No deposition of toner was found around the line picture image, and a good picture image having little blurring was obtained.

According to the present invention, development of an electrostatic image of a low electrical potential is made possible by effecting development of an electrostatic image using toner which has a high frictional charging effect as defined by the frictional charging index.

Further, an excellent developed picture image can be obtained since stabilized charging of toner can be attained by employing a toner as defined by the field-dependng index.

What is claimed is:

1. A method for developing an electrostatic image formed on an electrostatic image supporting member by using an insulative magnetic monocomponent developer, comprising:

providing a rotatable developer supporting member and a magnetic force generating means therewithin;

rotating said developer supporting member while holding said magnetic force generating means still; p1 applying an insulative magnetic monocomponent developer to said rotating developer supporting member for forming a brush of said developer which is constituted by a fixed layer against said developer supporting member which is not movable relative to said developer supporting member, and a movable layer on said fixed layer which is freely movable relative to said developer supporting member for producing electric charges in the developer by friction between said fixed layer and said movable layer; and bringing at least a part of said movable layer of said brush into contact with the face of said electrostatic image supporting member for developing the electrostatic image.

2. The method according to claim 1, wherein said developer, when there exists an electric field $E_0$ between said developer supporting member and another member, has a field depending index $b<1.0\times10^{-3}$, where $b=|\Delta V_t/\Delta E_0|$ which is the ratio of a coefficient of variation $\Delta V_t$ of the electrical potential $V_t$ of said developer with respect to the coefficient of variation $\Delta E_0$ of said electric field $E_0$.

3. The method according to claim 1, wherein said developer includes a charge control agent in order to promote said frictional charging effect of said developer.

4. The method according to claim 1, wherein said developer includes a fluidity improving agent in order to improve the fluidity and said frictional charging effect of said developer.

5. The method according to claim 1, wherein said developer supporting member has a roughened surface in order to improve said frictional charging effect of said developer.

* * * * *